US008075072B2

(12) United States Patent
Gwak

(10) Patent No.: US 8,075,072 B2
(45) Date of Patent: Dec. 13, 2011

(54) HOME BAR AND REFRIGERATOR INCLUDING THE HOME BAR

(75) Inventor: Young Hoon Gwak, Changwon-si (KR)

(73) Assignee: LG Electronics Inc., Seoul (KR)

( * ) Notice: Subject to any disclaimer, the term of this patent is extended or adjusted under 35 U.S.C. 154(b) by 756 days.

(21) Appl. No.: 12/062,402

(22) Filed: Apr. 3, 2008

(65) Prior Publication Data

US 2008/0246380 A1 Oct. 9, 2008

(30) Foreign Application Priority Data

Apr. 4, 2007 (KR) ..... 10-2007-0033454

(51) Int. Cl.
*A47B 97/00* (2006.01)

(52) U.S. Cl. ..... 312/292

(58) Field of Classification Search ..... 312/401–406, 312/408, 292, 327–328
See application file for complete search history.

(56) References Cited

U.S. PATENT DOCUMENTS 7,059,693 B2 * 6/2006 Park ..... 312/405.1
7,360,278 B2 * 4/2008 Jang et al. ..... 16/357
2001/0052741 A1 * 12/2001 Yun ..... 312/405
2004/0178710 A1 * 9/2004 Kim et al. ..... 312/405
2006/0119240 A1 * 6/2006 Shin et al. ..... 312/405
2006/0226750 A1 * 10/2006 Lee et al. ..... 312/405.1
2006/0226751 A1 * 10/2006 Park ..... 312/405.1
2008/0252191 A1 * 10/2008 Kim et al. ..... 312/405.1
2008/0278049 A1 * 11/2008 Park et al. ..... 312/405
2010/0084955 A1 * 4/2010 Choi ..... 312/405
2010/0095601 A1 * 4/2010 Ha ..... 49/506

FOREIGN PATENT DOCUMENTS

WO WO 2007/035049 * 3/2007

* cited by examiner

*Primary Examiner* — Darnell Jayne
*Assistant Examiner* — Timothy M Ayres
(74) *Attorney, Agent, or Firm* — Birch, Stewart, Kolasch & Birch, LLP

(57) ABSTRACT

Provided are a home bar and a refrigerator including the home bar. The home bar includes a home-bar frame, a home-bar door, and a damping hinge. The home-bar frame is mounted on a refrigerator door around an opening formed through the refrigerator door. The home-bar door is rotatably mounted on the home-bar frame for selectively opening and closing the opening. The damping hinge is detachably installed on the home-bar frame and is coupled to a side of the home-bar door for dampening a rotation force of the home-bar door. Therefore, the home bar can be easily repaired or replaced with low costs.

12 Claims, 6 Drawing Sheets

[fig.1]
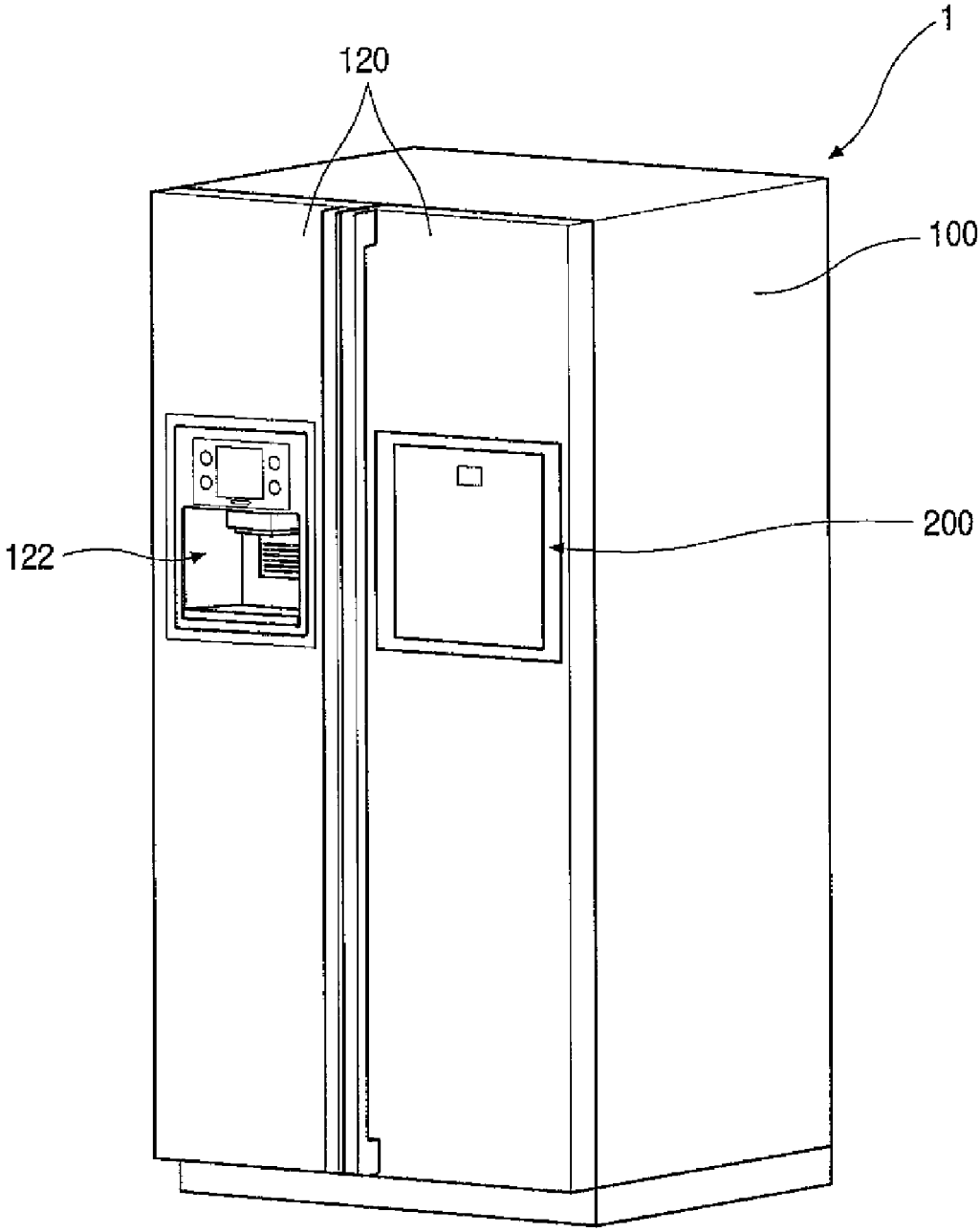

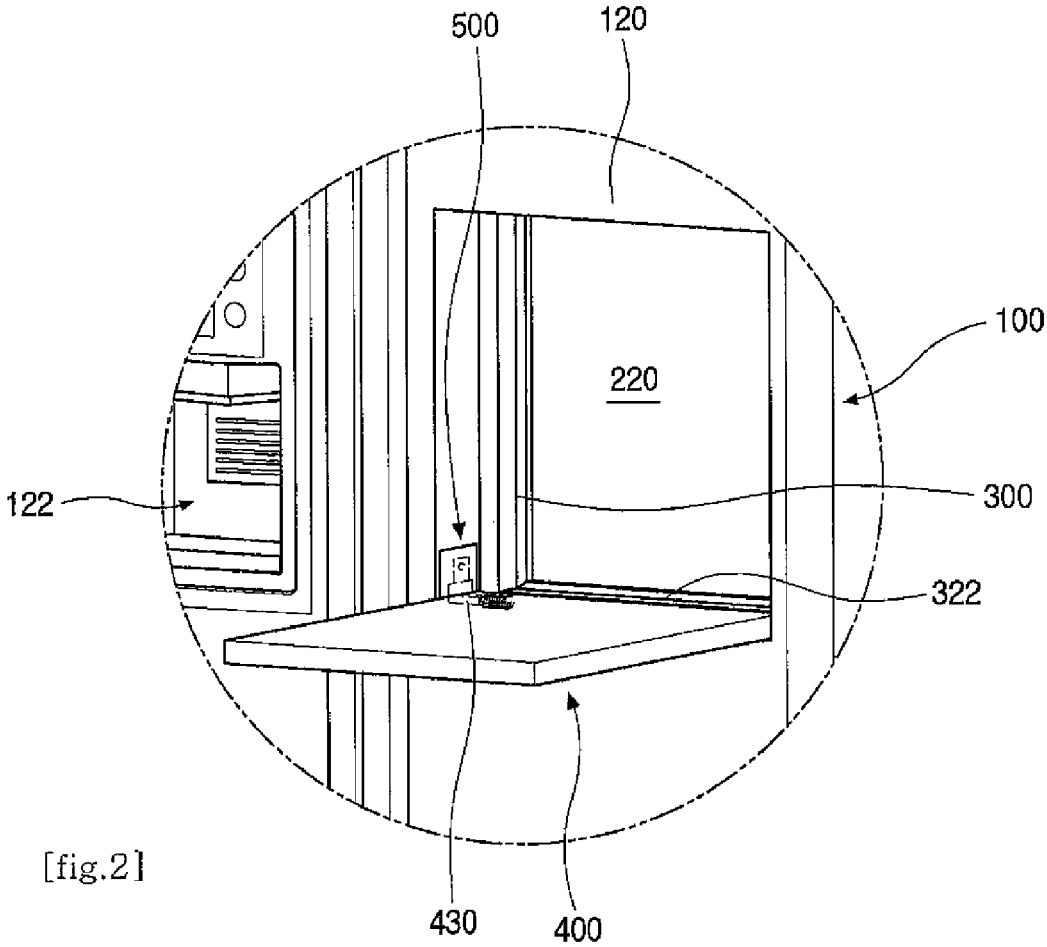
[fig.2]

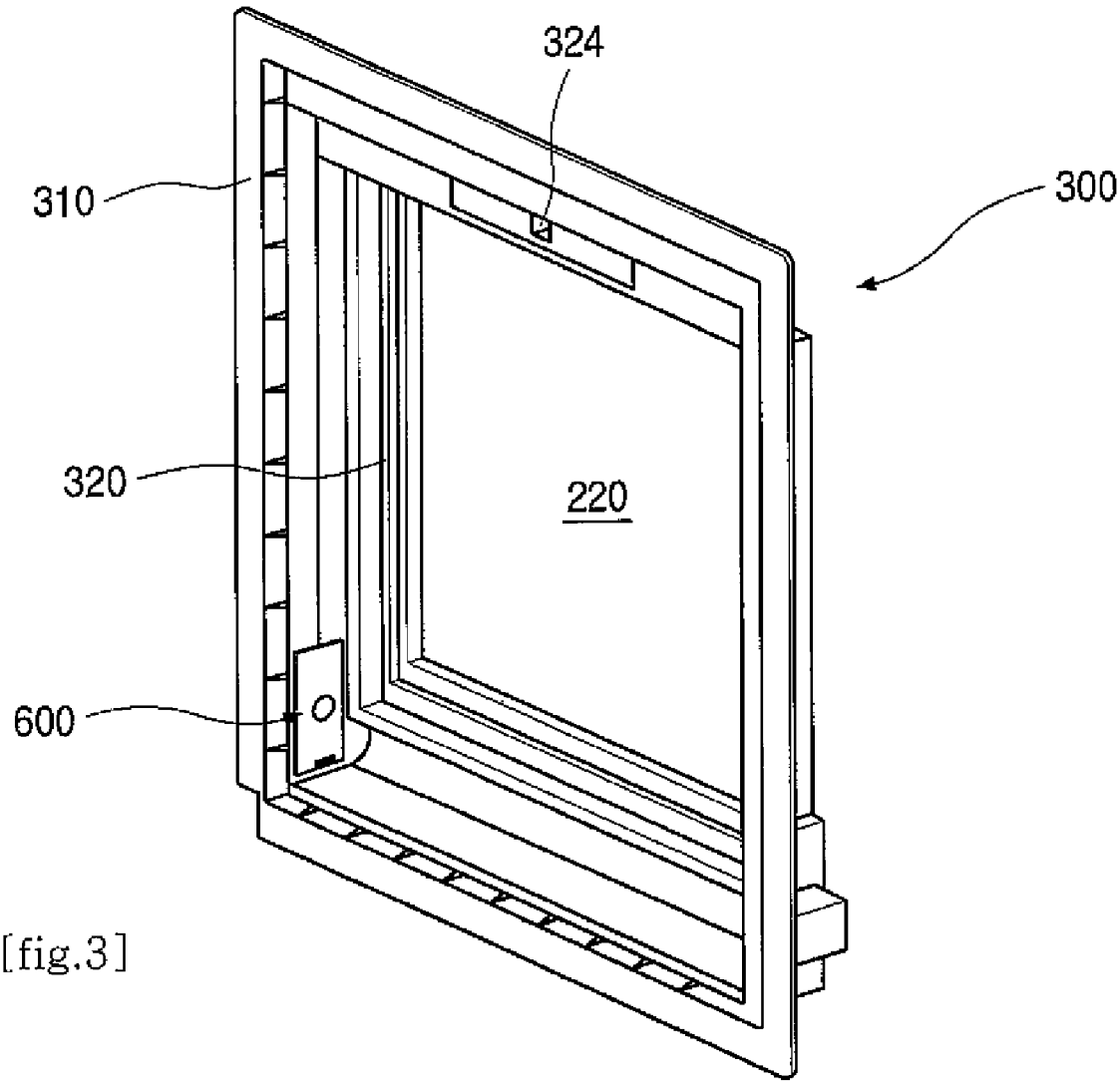
[fig.3]

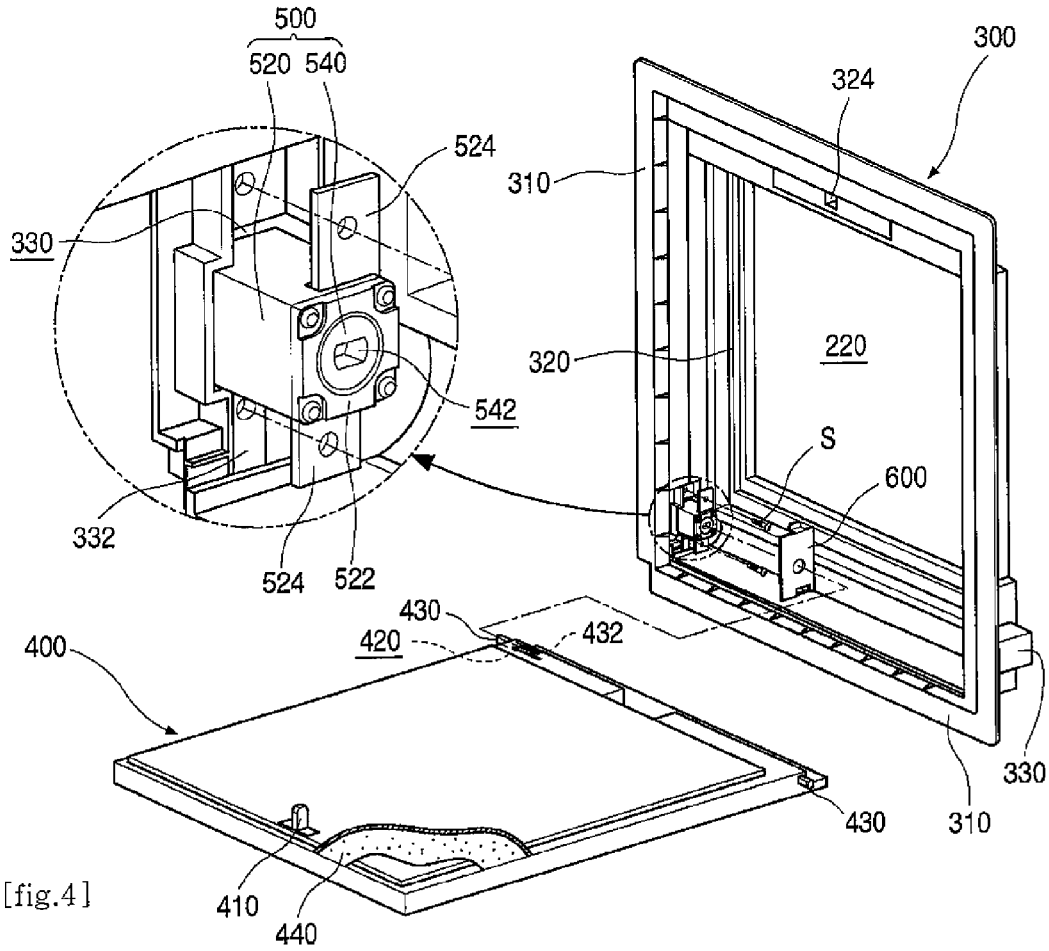
[fig.4]

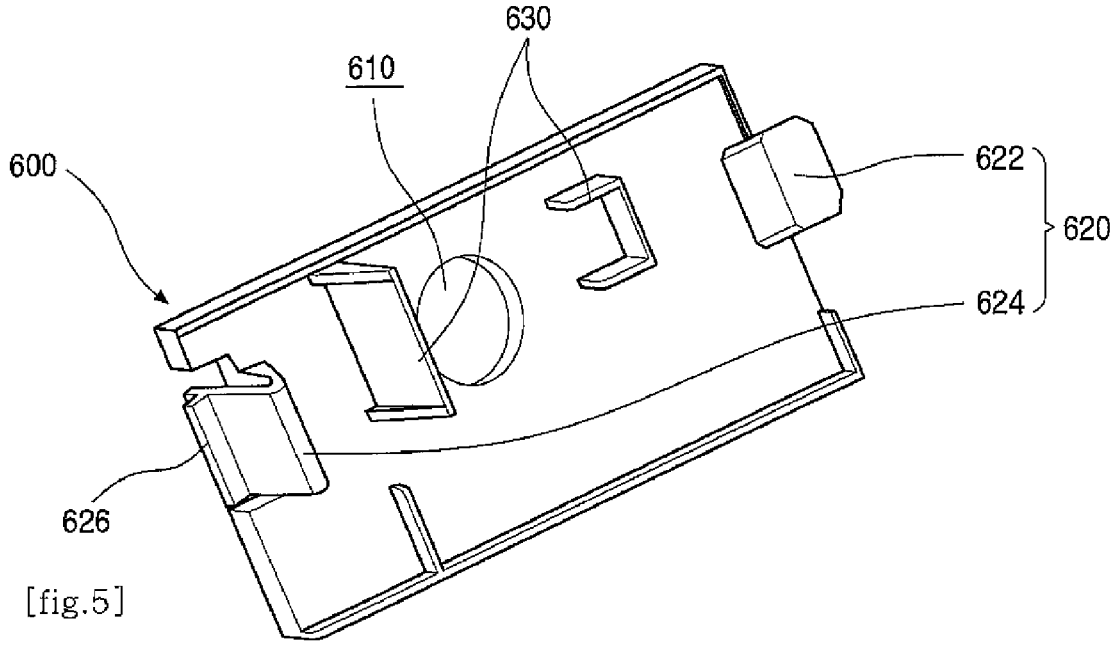
[fig.5]

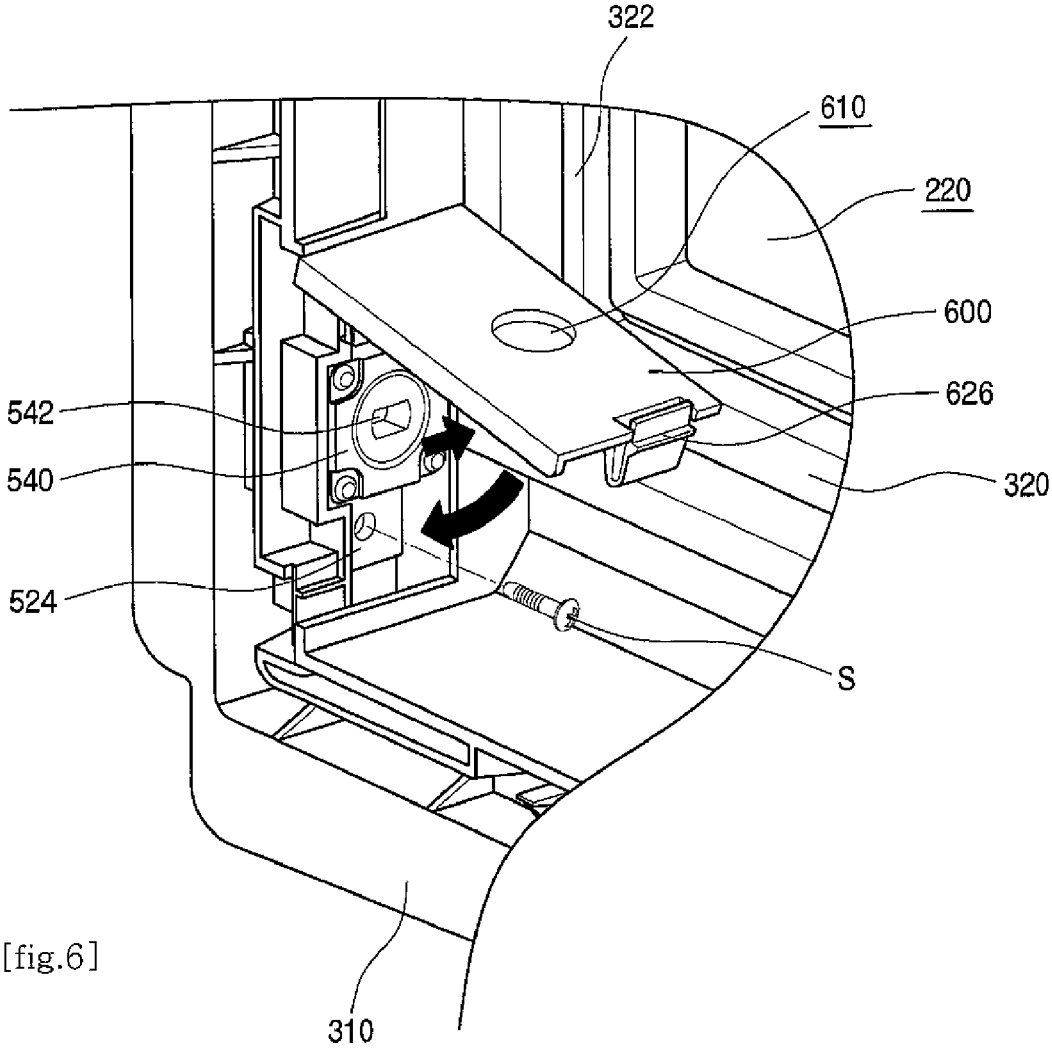
[fig.6]

HOME BAR AND REFRIGERATOR INCLUDING THE HOME BAR

CROSS-REFERENCE TO RELATED APPLICATIONS

The present application claims priority under 35 U.S.C. 119 and 35 U.S.C. 365 to Korean Patent Application No. 10-2007-0033454 (Apr. 4, 2007), which is hereby incorporated by reference in its entirety.

BACKGROUND

The present disclosure relates to a home bar and a refrigerator including the home bar.

Refrigerators are home appliances used for keeping food at a low temperature. For this, a storage room is formed in a refrigerator, and the storage room can be accessed through a door. The storage room is kept at a low temperature by taking heat from the storage room using a refrigerant so that food can be kept fresh in the storage room.

Due to changes in dietary life and well-being trends, consumers prefer larger, multi-functional refrigerators, and various convenient refrigerators have been introduced in the market.

Recently, consumers prefer home-bar refrigerators that have a home-bar door attached to an opening formed through a refrigerator door. Food stored in the home-bar refrigerator can be easily accessed through the home-bar door without having to open the refrigerator door. In addition, power consumption can be reduced when the home-bar door is used.

In general, hinges are installed on both sides of the home-bar door for allowing a user to open the home-bar door by rotating the home-bar door. The hinges can be fixed in the home-bar door using an insulating material filled in the home-bar door or additional fastening members. The use of the insulating material is still necessary in the case where the hinges are fixed using additional fastening members.

Ends of the hinges protruding from the home-bar door are coupled to a frame disposed around the opening of the refrigerator door so that the home-bar door can be rotated on the refrigerator door.

Dampers can be included in the hinges to decelerate the home-bar door when the home-bar door is opened. In this case, the home-bar door can be smoothly opened.

However, the related-art home-bar door has the following disadvantages.

When the hinges are damages or broken, the hinges cannot be selectively repaired. That is, in this case, the whole home-bar door or the refrigerator door may be replaced.

In detail, since the hinges fixed to the home-bar door are covered with the insulating material filled in the home-bar door, the hinges cannot be detached from the home-bar door for maintenance. Thus, the whole home-bar door may be replace when the hinges are damaged or broken.

Moreover, if the home-bar door is configured not to be detached from the refrigerator for maintenance, the whole refrigerator door should be replaced when the hinges are damaged or broken.

As explained above, it is difficult and takes much money to repair the related-art home-bar door.

SUMMARY

In one embodiment, a home bar includes: a home-bar frame mounted on a refrigerator door around an opening formed through the refrigerator door; a home-bar door rotatably mounted on the home-bar frame for selectively opening and closing the opening; and a damping hinge detachably installed on the home-bar frame and coupled to a side of the home-bar door for dampening a rotation force of the home-bar door.

In another embodiment, a home bar includes: a home-bar frame disposed around an opening formed through a refrigerator door from a front surface to a rear surface of the refrigerator door; a home-bar door having a shape corresponding to the opening and configured to selectively open and close the opening; an extendable rotation shaft disposed at each side of the home-bar door for rotatably installing the home-bar door; an accommodation portion formed by recessing a portion of each side of the home-bar frame; a damping hinge inserted in the accommodation portion and coupled with the rotation shaft for dampening rotation of the home-bar door; and a shield member disposed at a side of the home-bar frame for selectively covering the damping hinge.

In a further embodiment, a refrigerator includes: a main body forming a storage room; a refrigerator door configured to close the storage room; and a home bar, wherein the home bar includes: a home-bar frame mounted on the refrigerator door around an opening formed through the refrigerator door; a home-bar door rotatably mounted on the home-bar frame; and a damping hinge detachably installed on the home-bar frame and coupled to a rotation shaft of the home-bar door for dampening a rotation force of the home-bar door.

The details of one or more embodiments are set forth in the accompanying drawings and the description below. Other features will be apparent from the description and drawings, and from the claims.

BRIEF DESCRIPTION OF THE DRAWINGS

FIG. 1 is a perspective view illustrating a refrigerator including a home bar according to an embodiment.

FIG. 2 is a partial perspective view illustrating an opened state of a home-bar door of the home bar of the refrigerator according to an embodiment.

FIG. 3 is a perspective view illustrating a home-bar frame of the home bar according to an embodiment.

FIG. 4 is an exploded perspective view illustrating the home bar according to an embodiment.

FIG. 5 is a rear perspective view illustrating a shield member of the home bar according to an embodiment.

FIG. 6 is a perspective view illustrating an exemplary detaching operation of a damping hinge of the home bar according to an embodiment.

DETAILED DESCRIPTION OF THE EMBODIMENTS

Reference will now be made in detail to the embodiments of the present disclosure, examples of which are illustrated in the accompanying drawings. The present disclosure may, however, be embodied in many different forms and should not be construed as being limited to the embodiments set forth herein.

A Home bar described in the present disclosure can be applied to various refrigerators. In the following description, a side-by-side refrigerator will be explained as an example of such refrigerators.

FIG. 1 is a perspective view illustrating a refrigerator 1 including a home bar 200 according to an embodiment. Referring to FIG. 1, the refrigerator 1 includes a main body 100 having a hexahedral shape. The main body 100 forms the exterior of the refrigerator 1.

A storage room is formed inside the main body 100 for storing food. The storage room is divided into left and right compartments by a barrier. One of the compartments is a refrigerator compartment, and the other is a freezer compartment.

An opening is formed in a front side of the main body 100. Doors 120 are attached to the front side of the main body 100 where the opening is formed, in order to selectively open and close the refrigerator and freezer compartments.

The doors 120 are properly sized and shaped for closing and opening the refrigerator and freezer compartments, respectively. The doors 120 are installed on the main body 100 in a manner such that the doors 120 can be individually rotated inward and outward for selectively opening and closing the refrigerator and freezer compartments.

A dispenser 122 is provided on one of the doors 120. For example, a user can conveniently receive purified water and ice cubes through the dispenser 122 without having to open the door 120.

The home bar 200 is provided on the other of the doors 120 to allow a user to put food into the refrigerator 1 and take the food out of the refrigerator 1 without opening the door 120. For example, food stored in the storage room of the main body 100 or at a rear side of the door 120 can be easily accessed through the home bar 200.

In general, the home bar 200 may be provided on one of the doors 120 corresponding to the refrigerator compartment. Alternatively, if the dispenser 122 is not provided, the home bar 200 may be provided on the other of the door 120 corresponding to the freezer compartment. Alternatively, home bars may be provided on both the doors 120.

FIG. 2 is a partial perspective view illustrating an opened state of a home-bar door 400 of the home bar 200 of the refrigerator 1 according to an embodiment. The home bar 200 will now be described in more detail with reference to FIGS. 1 and 2.

Referring to FIGS. 1 and 2, the home bar 200 includes a home-bar frame 300, the home-bar door 400, and damping hinges 500 (one shown in FIG. 2).

The home-bar frame 300 is mounted on a position close to a center portion of the doors 120. The home-bar frame 300 is disposed around an opening 220 formed through the door 120. Food stored on a basket disposed at a rear side of the door 120 can be accessed through the opening 220. The home-bar frame 300 has a predetermined size and rectangular shape.

The home-bar door 400 is coupled to the home-bar frame 300. The home-bar door 400 has a size corresponding to the size of the opening 220. The home-bar door 400 is rotatably coupled to the home-bar frame 300 for selectively opening and closing the opening 220.

For this, a hinge unit is disposed between the home-bar door 400 and the home-bar frame 300. The hinge unit includes rotation shafts 430 (one shown in FIG. 2) and the damping hinges 500 in which the rotation shafts 430 can be inserted. Owing to the hinge unit, the home-bar door 400 can be rotated on a lower portion of the home-bar frame 300.

The rotation shafts 430 protrude outward from both sides of a lower edge portion of the home-bar door 400, and the damping hinges 500 are disposed on both sides of the home-bar frame 300 at positions corresponding to the positions of the rotation shafts 430. When the home-bar door 400 is installed on the home-bar frame 300, the rotation shafts 430 are coupled to the damping hinges 500 so that the home-bar door 400 can be rotated on the home-bar frame 300.

The opening 220 can be selectively opened and closed by rotating the home-bar door 400. When the home-bar door 400 is opened, the damping hinges 500 smooth the movement of the home-bar door 400.

FIG. 3 is a perspective view illustrating the home-bar frame 300 of the home bar 200 according to an embodiment, and FIG. 4 is an exploded perspective view illustrating the home bar 200 according to an embodiment. The home-bar frame 300 will now be described in more detail with reference to FIGS. 3 and 4.

The home-bar frame 300 has a rectangular shape corresponding to the shape of the opening 220 of the door 120. The home-bar frame 300 is coupled to the door 120. The home-bar frame 300 is disposed around the opening 220 of the door 120. The home-bar frame 300 has a width corresponding to the thickness of the door 120. The home-bar frame 300 may be formed of plastic by injection molding.

A frame mounting portion 310 is formed along front edges of the home-bar frame 300. The frame mounting portion 310 is perpendicularly bent and extends outward. Therefore, when the home-bar frame 300 is coupled to the door 120, the home-bar frame 300 can be brought into tight contact with a front side of the door 120.

A door fitting portion 320 is formed along rear edges of the home-bar frame 300. The door fitting portion 320 is inwardly bent. When the home-bar door 400 is closed, the door fitting portion 320 makes contact with a rear side of the home-bar door 400. A gasket 322 is disposed along the door fitting portion 320 so that the home bar 200 can be reliably sealed when the home-bar door 400 is closed.

A latch hole 324 may be formed in an upper portion of the home-bar frame 300 to receive a door latch 410 of the home-bar door 400. The latch hole 324 has a shape corresponding to the shape of the door latch 410. When the home-bar door 400 is closed, the door latch 410 is inserted into the latch hole 324 to lock the home-bar door 400 in the closed position.

Accommodation portions 330 are disposed on both sides of the lower portion of the home-bar frame 300. The damping hinges 500 are installed in the accommodation portions 330. The accommodation portions 330 may be formed by recessing lower side portions of the home-bar frame 300.

The accommodation portions 330 have a shape corresponding to the shape of the damping hinges 500 to stably receive the damping hinges 500. The accommodation portions 330 have a proper depth such that when the damping hinges 500 are installed in the accommodation portions 330, the damping hinges 500 may not protrude from the home-bar frame 300.

Upper and lower portions of the accommodation portion 330 may be stepped. For example, when the damping hinge 500 is installed in the accommodation portion 330, fixing parts 524 of the damping hinge 500 may be disposed on the upper and loser stepped portions of the accommodation portion 330, and a housing 520 of the damping hinge 500 may be disposed in a deep central portion of the accommodation portion 330. The upper and lower stepped portions of the accommodation portion 330 may have different depths for receiving the damping hinge 500 in a predetermined direction.

Brackets 332 may be disposed in the accommodation portions 330 for facilitating installation of the damping hinge 500. For this, the brackets 332 may have a shape corresponding to the shapes of the accommodation portions 330 and the damping hinges 500.

The damping hinges 500 are installed in the accommodation portions 330. The damping hinges 500 dampen a rotation force of the home-bar door 400 to decelerate the home-bar door 400. For this, the damping hinges 500 are coupled with the rotation shafts 430 of the home-bar door 400.

The damping hinge 500 will now be described in more detail with reference to FIG. 4. The damping hinges 500 include the housing 520 and an acting part 540. The housing 520 forms the exterior of the damping hinge 500, and the acting part 540 is disposed inside the housing 520.

The housing 520 is shaped like a hexahedron. The housing 520 is hollow to accommodate the acting part 540. The housing 520 has an opened front side (left side in FIG. 4), and a cover 522 covers the opened front side.

The cover 522 includes a circular hole having a predetermined diameter. A coupling slot 542 of the acting part 540 is exposed through the hole of the cover 522. Therefore, the rotation shaft 430 can be coupled to the coupling slot 542 of the acting part 540 through the hole of the cover 522.

The fixing parts 524 are formed on both sides of the front side of the housing 520. The damping hinge 500 disposed in the accommodation portion 330 can be securely fixed using the fixing parts 524. The fixing parts 524 have a substantially rectangular shape. The fixing parts 524 extend outward from top and bottom surfaces of the housing 520.

One of the fixing parts 524 extends upwardly, and the other of the fixing parts 524 extends downwardly. The fixing parts 524 are placed on different planes. For example, the lower one of the fixing parts 524 may be disposed behind the upper one of the fixing parts 524. In this case, although a moment is applied to the housing 520, the housing 520 will not easily moved.

Screw holes 526 are formed through center portions of the fixing parts 524. Screws (S) are inserted into the screw holes 526 for fixing the damping hinge 500. In detail, the screws (S) are inserted into the screw holes 526 of the fixing parts 524 and are fixed to the stepped portions of the accommodation portion 330 or the bracket 332 disposed in the accommodation portion 330.

The acting part 540 is disposed in the housing 520. The acting part 540 is coupled with the rotation shaft 430 and is rotated with the rotation shaft 430. When the acting part 540 is rotated, a fluid or a spring included in the acting part 540 dampens the rotation of the acting part 540. The acting part 540 has the structure as a well-known damper.

The front side of the acting part 540 is exposed through the hole of the cover 522, and the coupling slot 542 is formed in the exposed front side of the acting part 540. An end of the rotation shaft 430 is coupled to the coupling slot 542.

The coupling slot 542 has a shape corresponding to the shape of the end of the rotation shaft 430. The coupling slot 542 may be shaped like a keyhole. In this case, a rotational force can be easily transmitted from rotation shaft 430 to the acting part 540.

A shield member 600 covers an opened side of the accommodation portion 330. The shield member 600 has a rectangular shape corresponding to the shape of the opened side of the accommodation portion 330. The shield member 600 covers the accommodation portion 330 and confines the damping hinge 500 in the accommodation portion 330.

An insertion hole 610 is formed through an approximate center portion of the shield member 600. The rotation shaft 430 is inserted into the insertion hole 610. The insertion hole 610 is aligned with the coupling slot 542 of the acting part 540 such that the rotation shaft 430 can be coupled to the coupling slot 542 of the acting part 540 through the insertion hole 610. That is, the coupling slot 542 may be exposed through the insertion hole 610.

Fixing parts 620 are formed on the shield member 600 so that the shield member 600 can be coupled to the accommodation portion 330 by tight fitting. The shield member 600 can be fixed to the accommodation portion 330 of the home-bar frame 300. If necessary, the home-bar frame 300 can be detached from the home-bar frame 300.

When the shield member 600 is fixed to the accommodation portion 330, the accommodation portion 330 is completely covered with the shield member 600. In this state, as shown in FIG. 3, the outer surface of the shield member 600 is placed on the same plane as the inner surface of the home-bar frame 300. Therefore, installation and operations of the home-bar door 400 are not hindered by the shield member 600. The shield member 600 will be described later in more detail.

The home-bar door 400 has a shape corresponding to the shape of the opening 220 of the door 120 such that when the home-bar door 400 is closed to cover the opening 220, the home-bar door 400 forms a portion of the front side of the door 120.

Since the home-bar door 400 covers the storage room of the main body 100, an insulating material 440 is filled in the home-bar door 400. The insulating material 440 prevents the storage room of the main body 100 from being heated by ambient air. The insulating material 440 may be formed by filling a foaming material such as expandable polystyrene (EPS) in the home-bar door 400 and allowing the foaming material to foam.

The rotation shafts 430 are disposed on both sides of the lower portion of the home-bar door 400. The rotation shafts 430 function as a rotation center of the home-bar door 400. The rotation shafts 430 are disposed at positions corresponding to those of the damping hinges 500 so as to be coupled to the damping hinges 500. The rotation shafts 430 protrude outward from the home-bar door 400.

The rotation shafts 430 are coupled to the home-bar door 400 by inserting the rotation shafts 430 into the home-bar door 400. The rotation shafts 430 can be detached from the home-bar door 400. For example, elastic members 432 such as compression springs are disposed in the home-bar door 400, and the rotation shafts 430 are supported by the elastic members 432.

Therefore, the home-bar door 400 can be detached from the home-bar frame 300 by compressing the elastic members 432 to move the rotation shafts 430 inwardly away from the home-bar frame 300.

Adjustment holes 420 are formed in lower portions of the rear side of the home-bar door 400. Positions of the rotation shafts 430 in the home-bar door 400 can be adjusted through the adjustment holes 420. The adjustment holes 420 have a transversely elongated shape. Therefore, for example, an operator can move the rotation shaft 430 inwardly by pulling the rotation shaft 430 using a tool such as a pin.

FIG. 5 is a rear perspective view illustrating the shield member 600 of the home bar 200 according to an embodiment. The shield member 600 will now be described in more detail with reference to FIG. 5.

The insertion hole 610 is formed through an approximate center portion of the shield member 600. Restriction parts 630 are disposed on a rear side of the shield member 600. When the shield member 600 is coupled to the damping hinge 500, the restriction parts 630 make contact with the damping hinge 500 to firmly hold the damping hinge 500. The restriction parts 630 protrude from the rear side of the shield member 600 at positions close to the insertion hole 610.

The restriction parts 630 have shapes corresponding to the shapes of upper and lower sides of the damping hinge 500 for supporting the damping hinge 500. Therefore, when the shield member 600 is mounted on the home-bar frame 300 to cover the accommodation portion 330, the restriction parts 630 make tight contact with the housing 520 of the damping hinge 500 so that the damping hinge 500 can be firmly fixed.

The fixing parts 620 are disposed on the shield member 600 for selectively fixing the shield member 600. The fixing parts 620 are disposed on upper and lower portions of the shield member 600, respectively. The fixing parts 620 include an insertion part 622 and a hooking part 624.

The insertion part 622 protrudes from the upper portion of the shield member 600. When the shield member 600 is coupled to the accommodation portion 330, the insertion part 622 is inserted into the accommodation portion 330 so that the upper portion of the shield member 600 can be stably fixed. The insertion part 622 has a height corresponding to the thickness of the home-bar frame 300. The insertion part 622 can be inserted into the accommodation portion 330 in a direction from the accommodation portion 330 toward the home-bar frame 300.

Therefore, when the shield member 600 is coupled to the accommodation portion 330, the insertion part 622 is inserted into an upper region of the accommodation portion 330 such that the shield member 600 can be supported by the upper region of the accommodation portion 330 and be rotated on the insertion part 622.

The hooking part 624 extends backward from the lower portion of the shield member 600 and then is bent forward. Owing to this shape, the hooking part 624 is resilient in a vertical direction.

A hooking jaw 626 extends downward from a leading end of the hooking part 624. When the shield member 600 is coupled to the accommodation portion 330, the hooking jaw 626 is coupled to a lower portion of the accommodation portion 330. That is, when the hooking part 624 is inserted into the accommodation portion 330, the hooking jaw 626 is locked in the lower portion of the accommodation portion 330 so that the shield member 600 can be stably held.

The shield member 600 can be easily detached from the accommodation portion 330 by pushing the hooking part 624 upward to release the hooking jaw 626 from the lower portion of the accommodation portion 330.

An exemplary service operation of the home bar 200 will now be described with reference to the accompanying drawings.

FIG. 6 is a perspective view illustrating an exemplary detaching operation of the damping hinge 500 according to an embodiment.

Referring to FIGS. 1 to 6, the home bar 200 can be serviced as follows. A user can open the home-bar door 400 by rotating down the home-bar door 400 counterclockwise as shown in FIG. 2. When the home-bar door 400 is rotated down, the rotation shafts 430 of the home-bar door 400 are also rotated with the acting parts 540 of the damping hinges 500.

Therefore, the rotation of the home-bar door 400 is dampened by the damping hinges 500, and thus the home-bar door 400 can be smoothly rotated down. When the home-bar door 400 is rotated by about 90° □, the opening 220 is completely opened.

In this state, the user can access food stored in the storage room of the refrigerator 1, and if necessary, the user or a serviceman can repair the home bar 200.

If necessary, any one as well as a skilled serviceman can repair or replace the damping hinges 500 of the home bar 200 as follows. First, after completely opening the home-bar door 400, the rotation shaft 430 can be moved inwardly by inserting a tool such as a pin into the adjustment hole 420 and pushing the rotation shaft 430 inwardly using the tool.

The rotation shaft 430 is inwardly moved in this way, and thus the coupling between the rotation shaft 430 and the damping hinges 500 is released. Therefore, the home-bar door 400 can be detached from the home-bar frame 300.

When the rotation shaft 430 is inwardly moved, the elastic member 432 is compressed. Thus, if the force applied to the rotation shaft using the tool is removed, the rotation shaft rotation shaft 430 can be returned to its original position by the elastic member 432.

After detaching the home-bar door 400 from the home-bar frame 300, the shield member 600 is detached from the home-bar frame 300. For this, a user can push the hooking part 624 of the shield member 600 upwardly to release the hooking jaw 626 from the lower portion of the accommodation portion 330.

Then, the shield member 600 can be completely separated from the accommodation portion 330 by rotating the shield member 600 upward on the insertion part 622 and pulling the shield member 600.

After the shield member 600 is detached, the front side of the damping hinge 500 is exposed through the hole of the cover 522, and the fixing parts 524 of the damping hinge 500 are exposed. Then, the user can detach the damping hinge 500 from the accommodation portion 330 after disconnecting the screws (S) from the fixing parts 524 of the damping hinge 500.

Thereafter, for example, the user can dispose a new damping hinge 500 in the home-bar frame 300 and fix the damping hinge 500 to the accommodation portion 330 using the screws (S).

Then, the shield member 600 is re-attached to the accommodation portion 330 by inserting the insertion part 622 of the shield member 600 into the upper portion of the accommodation portion 330 and rotating down the shield member 600 on the insertion part 622 to insert the hooking part 624 of the shield member 600 into the lower portion of the accommodation portion 330. Here, the hooking jaw 626 of the hooking part 624 is locked in the lower portion of the accommodation portion 330 so that the shield member 600 can be securely fixed to the accommodation portion 330.

Thereafter, while pushing the rotation shaft 430 inwardly, the lower portion of the home-bar door 400 is placed in the home-bar frame 300. Then, the rotation shaft 430 is released to allow the rotation shaft 430 to protrude from the home-bar door 400 and couple with the acting part 540 of the damping hinge 500. In this way, the home-bar door 400 can be recoupled to the home-bar frame 300.

In this way, the damping hinge 500 can be replaced. Then, the home-bar door 400 can be closed by rotating the home-bar door 400 upward (clockwise in FIG. 2).

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

For example, in the above-described embodiments, the damping hinge 500 and the rotation shaft 430 of the hinge unit are disposed at the home-bar door 400 and the home-bar frame 300, respectively. However, the damping hinge 500 and the rotation shaft 430 can be provided as a module. In this case, the module can be detachably attached to an inner side of the home-bar frame 300. In addition, the hinge unit may not have a damping function. That is, the hinge unit can be used to allow rotation of the home-bar door 400 without providing a damping function.

What is claimed is:

1. A home bar comprising:

a home-bar frame mounted on a refrigerator door around an opening formed through the refrigerator door;

a home-bar door rotatably mounted on the home-bar frame for selectively opening and closing the opening;

a rotation shaft disposed at each side of the home-bar door for rotatably installing the home-bar door;

an accommodation portion formed by recessing a portion of a side of the home-bar frame and opened toward the opening side of the home-bar frame;

a damping hinge inserted in the accommodation portion and coupled with the rotation shaft for dampening rotation of the home-bar door;

a shield member disposed at a side of the home-bar frame for selectively covering the damping hinge; and an insertion hole formed through the shield member so that the rotation shaft is inserted into the insertion hole to connect the damping hinge, wherein the shield member and damping hinge are detached from the home-bar frame through the opening of the home-bar frame.

2. The home bar according to claim 1, further comprising an elastic member disposed in the home-bar door for supporting the rotation shaft.

3. The home bar according to claim 2, wherein the home-bar door comprises an adjustment hole formed in a rear side of the home-bar door at a position corresponding to the rotation shaft for moving the rotation shaft through the adjustment hole.

4. The home bar according to claim 1, further comprising a bracket disposed in the accommodation portion for installing the damping hinge in the accommodation portion.

5. The home bar according to claim 1, wherein the damping hinge comprises:

a housing configured to be inserted in the accommodation portion;

an acting part disposed in the housing and coupled with the rotation shaft for being rotated with the acting part; and a fixing part protruding outward from the housing and fixed to a side of the accommodation portion.

6. The home bar according to claim 5, wherein the fixing part is disposed in the accommodation portion and fixed to the accommodation portion using a screw.

7. The home bar according to claim 5, wherein the damping hinge further comprises another fixing part, wherein the fixing parts extend perpendicularly from upper and lower surfaces of the housing and are placed on different planes.

8. The home bar according to claim 1, wherein the shield member is detachably attached to the home-bar frame and makes tight contact with the damping hinge for confining the damping hinge in the accommodation portion.

9. The home bar according to claim 1, wherein when the shield member covers the damping hinge, an outer surface of the shield member is placed on the same plane as an inner surface of the home-bar frame.

10. The home bar according to claim 1, wherein the shield member comprises:

an insertion part protruding backward and insertable into a side of the home-bar frame; and a hooking part disposed at a position opposite to the insertion part and having an elastically deformable shape for coupling with the home-bar frame.

11. The home bar according to claim 1, wherein the rotation shaft of the home-bar door is movable into the home-bar door.

12. The home bar according to claim 1, wherein the damping hinge is exposed to the opening side of the home-bar frame when the shield member is detached from the home-bar frame.

* * * * *